US007946731B1

(12) United States Patent
Wray

(10) Patent No.: US 7,946,731 B1
(45) Date of Patent: May 24, 2011

(54) POWER LED CHANNEL LETTER LIGHTING MODULE

(75) Inventor: Donald Lee Wray, Ocala, FL (US)

(73) Assignee: J&J Electronics, Inc., Irvine, CA (US)

( * ) Notice: Subject to any disclaimer, the term of this patent is extended or adjusted under 35 U.S.C. 154(b) by 738 days.

(21) Appl. No.: 11/707,657

(22) Filed: Feb. 15, 2007

Related U.S. Application Data

(60) Provisional application No. 60/773,830, filed on Feb. 15, 2006.

(51) Int. Cl.
*F21V 29/0011* (2006.01)

(52) U.S. Cl. ..... 362/294; 362/249.02; 362/249.11; 362/373

(58) Field of Classification Search ..... 361/704, 361/709, 711, 751, 716, 720, 721; 362/240, 362/245, 246, 247, 249.1, 249.2, 249.16, 362/253, 294, 311.01, 311.02, 311.14, 311.15, 362/373, 555, 559, 565, 800, 806, 812; 257/675, 257/98–100; 40/541, 564, 570, 572, 578
See application file for complete search history.

(56) References Cited

U.S. PATENT DOCUMENTS

| | | | |
|---|---|---|---|
| 6,578,986 | B2 | 6/2003 | Swaris et al. |
| 6,712,486 | B1 | 3/2004 | Popovich et al. |
| 6,846,093 | B2 | 1/2005 | Swaris et al. |
| 6,932,495 | B2 | 8/2005 | Sloan et al. |
| 7,045,965 | B2 | 5/2006 | Li et al. |
| 7,125,143 | B2 | 10/2006 | Hacker |
| 7,175,306 | B2 | 2/2007 | Pan |

*Primary Examiner* — Hargobind S Sawhney
(74) *Attorney, Agent, or Firm* — Robert D. Buyan; Stout, Uxa, Buyan & Mullins

(57) ABSTRACT

Light Emitting Diode (LED) modules that generally comprise a) a frame or housing, b) a circuit board that comprises a solid state circuit and is mounted on the frame or in the housing, c) one or more LEDs connected to the solid state circuit and d) at least one of the following: i) a heat sink that extends outboard (e.g., outside the outer boundaries of) the housing or frame; and/or ii) a power regulator which controls power dissipation over load and line variations and/or a pulse regulation circuit which to regulates current pulses in the LEDs in the unfiltered full wave unregulated 60 cycle Hz alternating current (AC). These LED modules may be connected to one another in series and my operate on AC current. In some embodiments, these LED modules are used for channel letter lighting and other illuminated signage applications.

14 Claims, 5 Drawing Sheets

POWER LED CHANNEL LETTER LIGHTING MODULE

RELATED APPLICATION

This patent application claims priority to U.S. Provisional Application No. 60/773,830 filed Feb. 15, 2006, which is expressly incorporated herein by reference.

FIELD OF THE INVENTION

This invention relates generally to electronic lighting systems and more particularly to light emitting diode (LED) systems that are useable for lighting channel letters and for other applications.

BACKGROUND OF THE INVENTION

LEDs are a solid state lamps that use semiconductor material instead of a filament or neon gas. When compared to traditional (i.e., fluorescent or incandescent) light bulbs, LEDs offer a number of advantages. For example, because LEDs operate on low voltage and consume less power, they are less expensive to operate and generate significantly less heat than traditional light bulbs. Also, because LEDs are of solid state design, they are more durable and less likely to break than traditional bulbs. Another advantage of LEDs is their long life. Some LED lamps can operate for up to 100,000 hours, compared to about 1500 hours for a standard filament light bulb. Moreover, LEDs are environmentally friendly, contain no mercury and produce no electromagnetic emissions. Another advantage is that a single LED bulb can produce many different colors without the need for colored coatings or lenses.

The prior art has included a number of LED lighting modules. For example, U.S. Pat. No. 7,175,306 (Pan) describes an LED illuminating module includes a supporting frame and an illuminating unit. The supporting frame has a top surface and an elongated reflective channel indented on the top surface and defining a peripheral reflective wall inclinedly extended from a bottom wall of the reflective channel. The illumination unit includes a light circuit supported by the supporting frame and a plurality of illuminators which are electrically mounted to the light circuit and spacedly aligned along the reflective channel, wherein each of the illuminators forms as a point of light source for radially emitting light towards the reflective wall, such that the reflective wall is adapted for reflectively accumulating the lights of the illuminators within the reflective channel, so as to merge the points of light source to form a line of light source along the reflective channel.

U.S. Pat. No. 7,125,143 (Hacker) describes an LED module having a plurality of mixed-light LEDs and additional LEDs, wherein each of the additional LEDs has a plurality of LED chips. The LED chips have different emission wavelengths, which, in each instance, are arranged in a common housing.

U.S. Pat. No. 7,045,965 (Li et al.) describes a lighting module that includes a pair of LEDs having the same polarity connected in parallel. These parallel LEDs with the same polarity are purported to increase the reliability of the light module and make it suitable for use in light strings where a relatively large number of such light modules are connected in series and where the failure of one such light module will cause the failure of the entire light string.

One area where LED lighting modules are now used is in the lighting of channel letter signage. Channel letter sinage typically consists of a series of Iluminated channel letters, each of which consists of a channel (e.g., generally "U" shapped) housing in the form of a letter, one or more light emitters mounted within the channel housing and a translucent lens positioned over the front of the housing to transmit light from within the housing. Channel letters are commonly found on the outside of buildings and are often used to advertise the name of the business. Channel letters have typically been illuminated by neon or fluorescent light sources that are mounted within the channel housing. However, such neon and fluorescent light sources have a relatively short operating lives, are fragile, require high voltage (e.g., 7,000 to 15,000 volts for neon) and can be expensive to operate because they consume substantial amounts of power.

U.S. Pat. No. 6,923,495 (Sloan et al.) describes the use of LEDs for channel letter lighting and, in particular, a channel letter lighting unit that comprises a printed circuit board (PCB) having a linear row of light emitting elements, such as LEDs. Input wires transmit a power signal to the PCB to illuminate the plurality of light emitting elements, and output wires transmit the power signal from the PCB. The PCB is mounted within an elongate, thermally conductive extrusion such that light emitted from the row of LEDs transmits light away from the extrusion. The extrusion purportedly promotes the dissipation of heat from the LEDs. A mounting mechanism is included for mounting the extrusion within a channel letter housing. A plurality of these channel lighting units may be electrically connected to one another so that a power signal applied to the lighting system is transmitted to each of the plurality of lighting units.

There remains a need in the art for the development of improved LED lighting modules that may be useable in channel letter lighting applications and/or other applications.

SUMMARY OF THE INVENTION

The present invention provides LED lighting modules and methods useable for various applications, including but not limited to channel letter lighting.

In accordance with this invention, there are provided LED lighting modules that generally comprise: a) a frame or housing, b) a circuit board that comprises a solid state circuit and is mounted on the frame or in the housing, c) one or more LEDs connected to the solid state circuit and d) at least one of the following:

i) a heat sink that extends outboard (e.g., outside the outer boundaries of) the housing or frame; and/or ii) a power regulator which controls power dissipation over load and line variations and/or a pulse regulation circuit which to regulates current pulses in the LEDs in the unfiltered full wave unregulated 60 cycle Hz alternating current (AC).

In embodiments of the LED module which incorporate the heat sink, such heat sink may comprise a central portion which resides within the frame or housing (e.g., in contact with the circuit board) and one or more outer portion(s) (e.g., wing(s) or other protrusion(s)) that extend outboard of the frame or housing. The outer portion(s) may have openings (e.g., slots or other holes or apertures) through which air may circulate. Additionally or alternatively, the outer portion(s) of the heat sink may be configured such that all or part of the outer portion(s) remain a spaced distance away from a surface on which the LED module assembly is mounted, thereby allowing air to circulate between that surface and the outer portion(s) of the heat sink.

In some embodiments of the LED module which incorporate the power regulator, such power regulator may comprise a zener clamped base drive voltage in a full wave rectified voltage applied to the LED(s) to control power dissipation over load and line variations. In other embodiments, the power regulator may comprise a voltage reference and a transistor which operate on full waive rectified alternating current (AC). The inclusion of such power regulator provides better control of current to the LED(s) enables the use of AC voltage between LED serially connected LED modules thereby reducing the potential for electrolysis and/or interconnect corrosion.

Further in accordance with the present invention, there are provided channel letter devices and systems which incorporate one or more LED module assemblies of the present invention as light sources.

Still further in accordance with the present invention, there are provided methods for operating a series of LED modules, such methods comprising the use of AC voltage between the modules so as to reduce electrolysis and/or interconnect corrosion.

Further aspects, elements and objects of the present invention will become apparent to those of skill in the art upon reading of the detailed description and examples set forth below.

DETAILED DESCRIPTION AND EXAMPLES

The following detailed description and examples, as well as the accompanying drawings, are illustrative in nature. They are provided for the purpose of describing some, but not all, possible embodiments or examples of the invention and shall not be construed as limiting the scope of the invention in any way.

LED lighting for use in channel letters is currently available. Such channel letter LED lighting typically consists of a series of modules, each module consisting of a circuit board with a group of LEDs mounted thereon. These LED modules are wired in series and mounted within the channel letters such that the LEDs provide uniform light which is cast through a translucent panel on the face of each letter.

The present invention provides high power LED devices and systems useable for lighting relatively large channel letters and for other lighting applications such as light box illumination, back lighting, cove lighting, signage lighting, integration into luminaries, etc. In accordance with this invention there is provided, for example, a multiple 1 Watt LED, module that is useable for a variety of specific applications including but not limited to the illumination of relatively large channel letters (e.g., channel letters greater than 30 inches in height), menu board illumination applications, illuminated street sign applications, illuminated Kiosk applications and high brightness LED applications.

Figure 1:
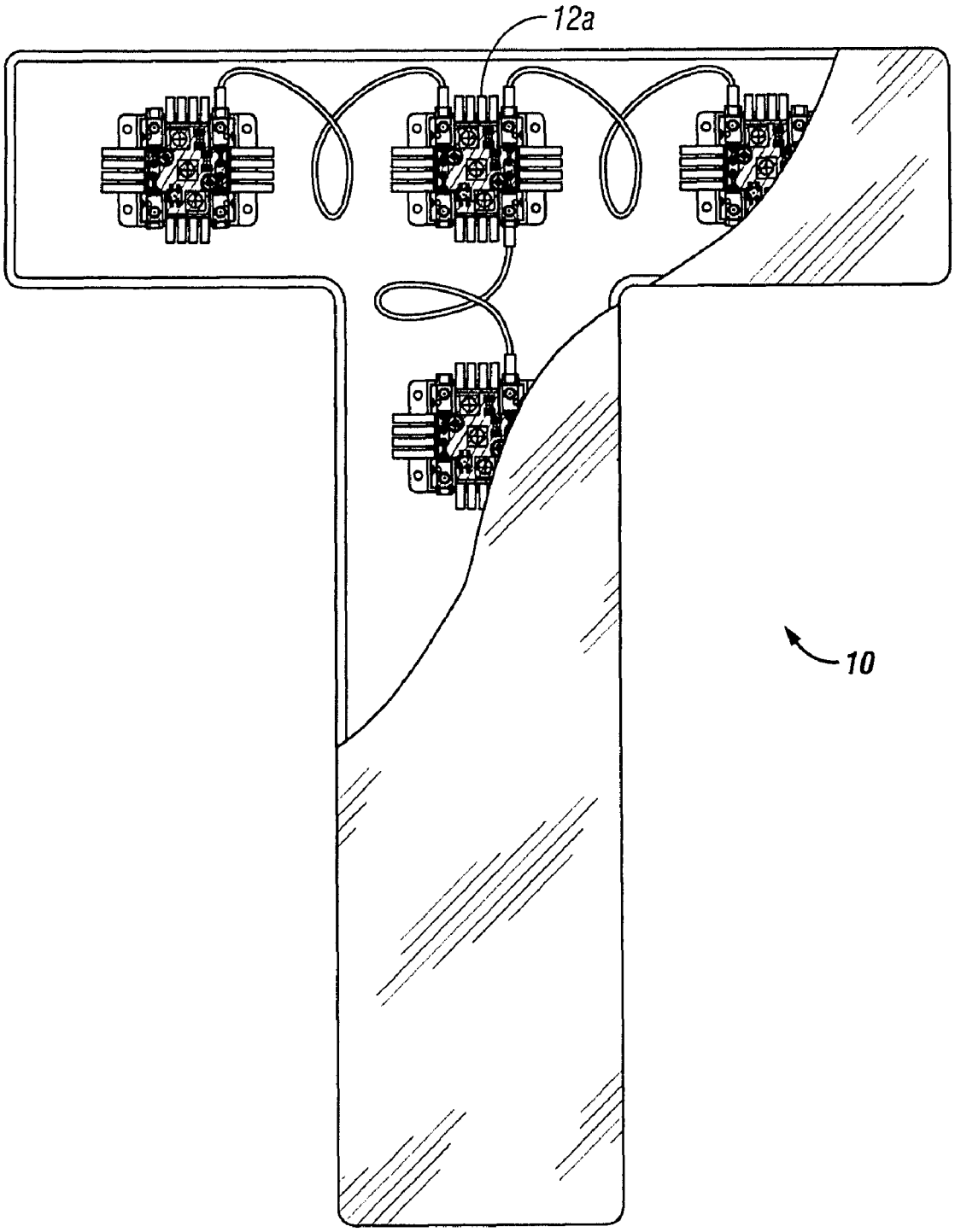
FIG. 1 is a cut-away view of a channel letter having LED lighting module assemblies of the present invention mounted therein.

FIG. 1 shows a channel letter 10 which comprises a channel letter frame 11 having a plurality of LED modules 12*a*, 12*b* of the present invention mounted therein and a translucent cover 13 mounted on the channel letter frame 11 such that light from the LED modules 12*a*, 12*b* will pass through the translucent cover 13.

Figure 2:
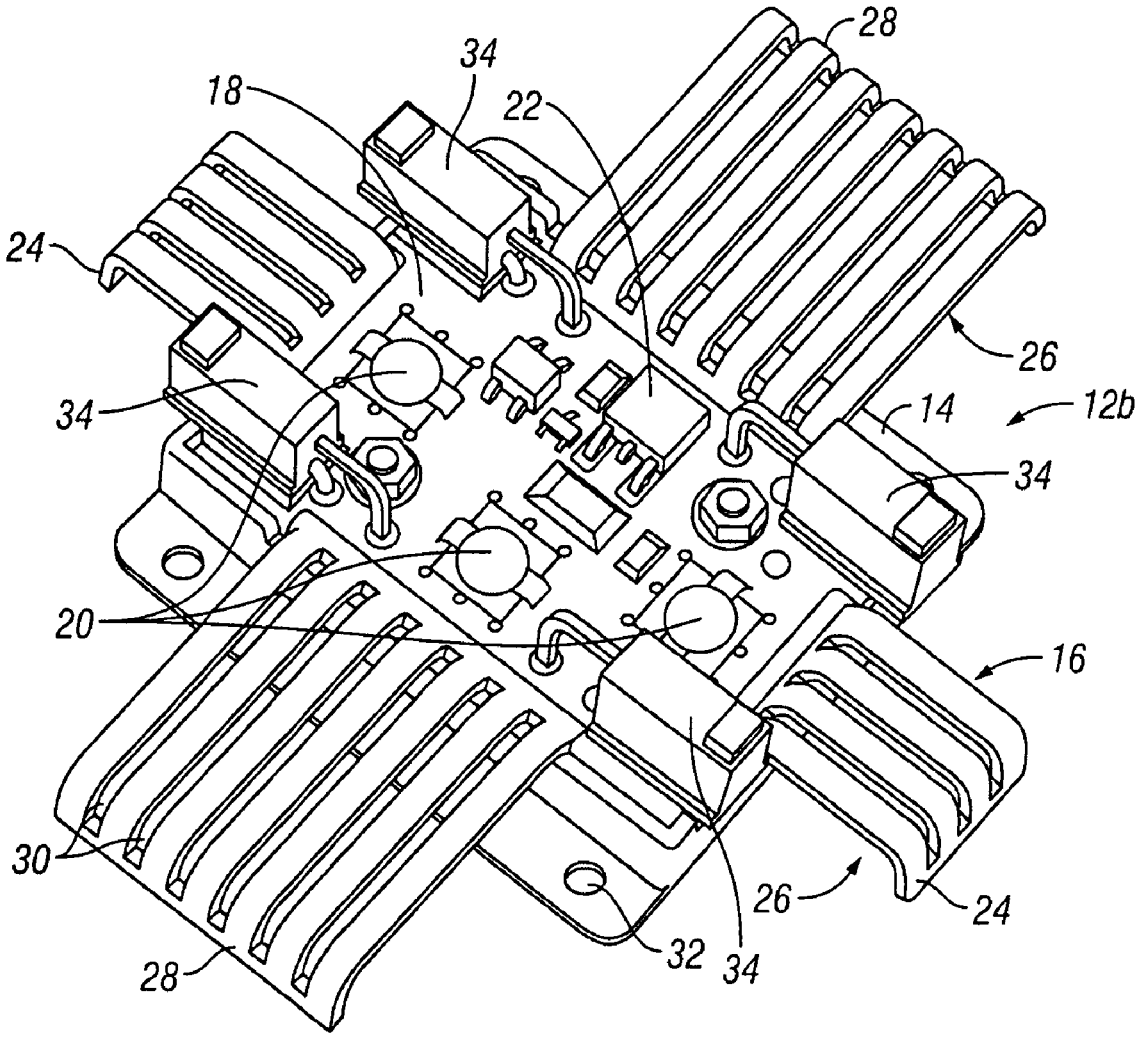
FIG. 2 is a perspective view of one embodiment of an LED lighting module assembly of the present invention.
Figure 3:
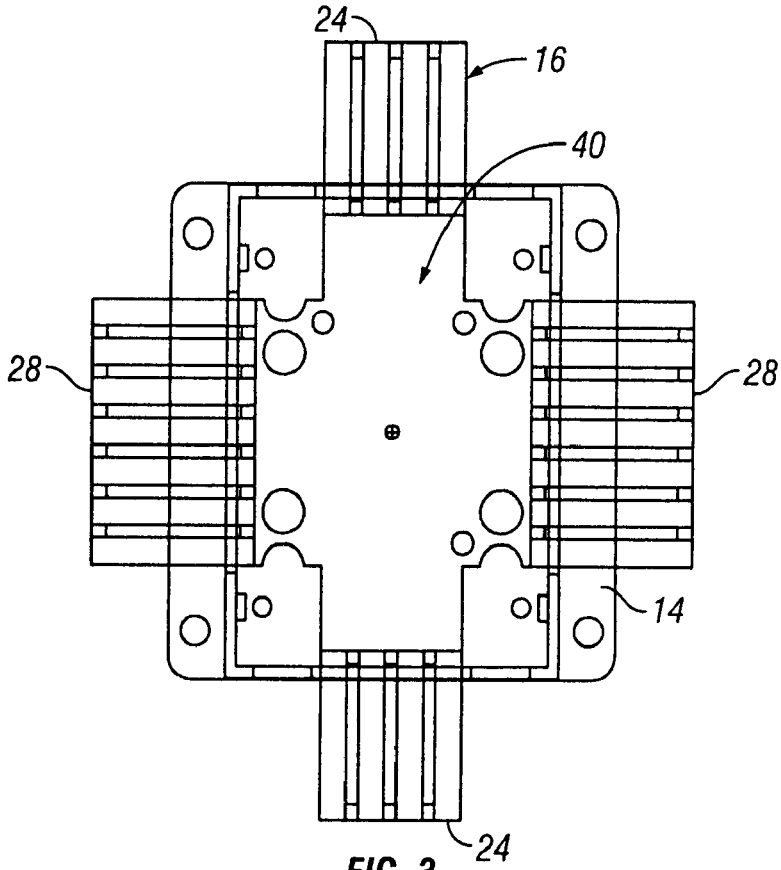
FIG. 3 is a top view of the housing and heat sink portions of the LED module assembly of FIG. 2.
Figure 4:
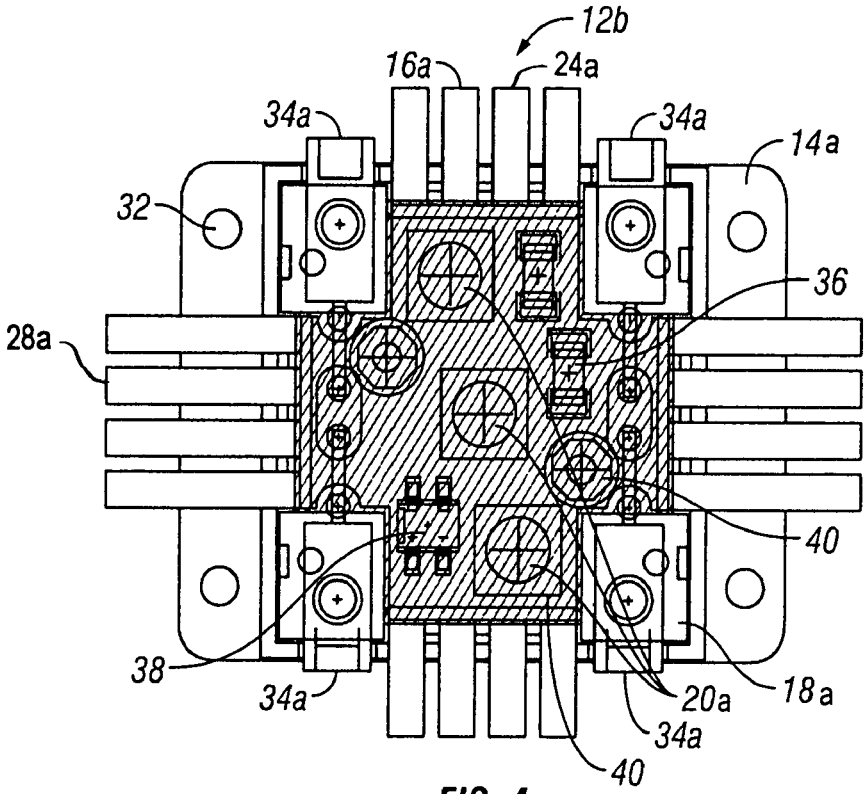
FIG. 4 is a lay-out drawing of another embodiment of an LED lighting module of the present invention.
Figure 5:
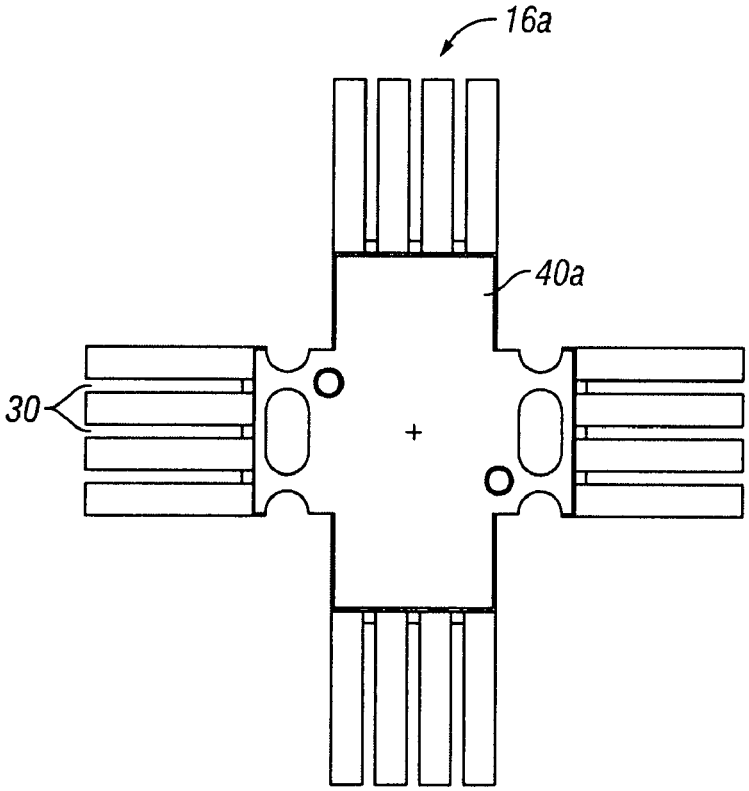
FIG. 5 is a top view of the heat sink component of the LED module assembly of FIG. 4.
Figure 5B:
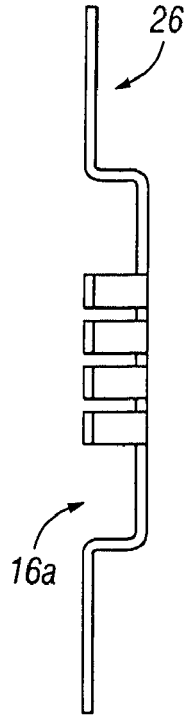
Figure 5A:
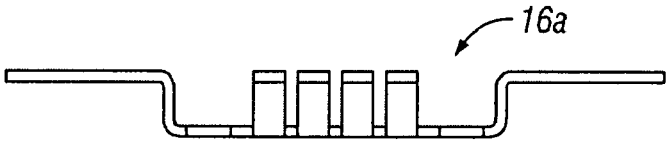
Figure 6:
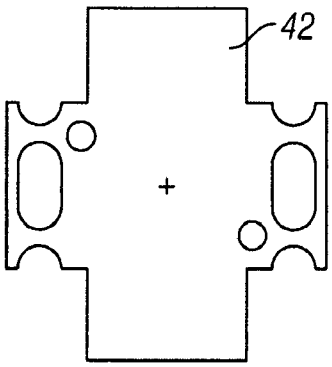
FIG. 6 is a top view of a thermal tape component that is positioned between the heat sink component and the housing of the LED module assembly of FIG. 4.

FIG. 2 shows one embodiment of an LED module 12*a* of the present invention. This LED module 12*a* comprises a circuit board 18 such as a solid state printed circuit board (PCB) that is fully or partially mounted on a substantially flat frame or, as shown in FIG. 2, within a concave or raised housing 14. Such housing 14 (or frame) may be formed of any suitable material such as an electrically insulating plastic (e.g., polypropylene) or other suitable electrically insulating material. The housing 14 (or frame) may be attachable to a surface, such as the surface of a channel letter housing 11. To facilitate such attachment apertures such as screw or bolt holes 32 may be formed in the housing to allow it to be screwed or bolted to a surface and/or adhesive (e.g., VHB adhesive tape) may be provided on the underside of the housing 14 to cause it to adhere to a desired surface. As those of skill in the art will appreciate, various other types of connectors (e.g., hooks, clips, clamps, magnets, Velcro hook and loop connectors, etc.) may also be provided to facilitate mounting or attachment of the module 12*a* to a desired surface.

In the LED module 12*a* shown in FIG. 2, the circuitry on the circuit board 18 includes a power NPN transistor 22 which regulates power to the LEDs 20. This may use a 12 volt AC power source that is full wave rectified by using a bridge rectifier. The unfiltered DC is regulated with a novel design using an NPN transistor 22 in a common emitter configuration. A zener diode (D2 on the circuit diagram of FIG. 7) is used to regulate voltage pulses thus controlling the LED Current. Current is set to an average 300 to 400 mA. to drive the LED's 20. Total power consumption is 5 Watts per module nominal. Current can vary over line drop and temperature; however nominal module light output should be above 75 Lumens.

FIGS. 4-6 and 7A show a second embodiment of an LED module 12*b* of the present invention. This LED module 12*b* is of the same construction as the first embodiment of the LED module 12*a* shown in FIG. 2 except that:

In either embodiment, the heat sink 16, 16*a* has a central portion 40, 40*a* that resides between the circuit board 18, 18*a* and the floor of the housing 14. The outer portions 24, 24*a*, 28, 28*a* of the heat sink 16, 16*a* extend outboard of the frame or housing 14. A thermally conductive material, such as thermal tape 42 having adhesive on both sides may be positioned between the central portion 40, 40*a* of the heat sink 16, 16*a* and the circuit board 18 to conduct heat away from the circuit board 18 and into the heat sink 18, 18*a*. Such heat will then be conducted to the outer portions 24, 28 of the heat sink 16, 16*a* and will dissipate therefrom.

In some embodiments, the outer portions 24, 24*a*, 28, 28*a* of the heat sink 16, 16*a* may be configured such that an air flow space 26 exists between them and a surface upon which the LED module 12*a*, 12*b* is positioned. Also, in some embodiments, openings such as slots 30 may be formed in the outer portions 24, 24*a*, 28 28*a* of the heat sink 16, 16*a* to allow air flow therethrough. In the particular example shown in FIG. 2, the outer portions 24 that extend from the ends of the LED module 12*a* are smaller than the outer portions 28 that extend from the sides of the module 12*a*. However, it will be appreciated that the number, size and shape of the outer portions of the heat sink 18 may vary depending on the number and size of the LEDs 20 in use and the amount of heat to be dissipated. For example, the alternative embodiment of the LED module 12*b* shown in FIGS. 4-6 incorporates a heat sink 16*a* having outer portions 24*a*, 28*a* which are of substantially the same width but which differ in length. In some embodiments, the outer portions 24, 24*a*, 28, 28*a* may be constructed so that they do not touch (i.e., they remain a spaced distance way from) a surface on which the LED module 12*a*, 12*b* is mounted while in other embodiments one or more location(s) (e.g. the outer edge) of the outer portions 24, 24*a*, 28, 28*a* may be constructed so that they do touch a surface on which the LED module 12*a*, 12*b* is mounted to stabilize the module and/or to facilitate some dissipation of some heat from the outer portions 24, 24*a*, 28, 28*a* of the heat sink 16, 16*a* into that adjacent surface (if it is safe and appropriate to do so).

Figure 7:
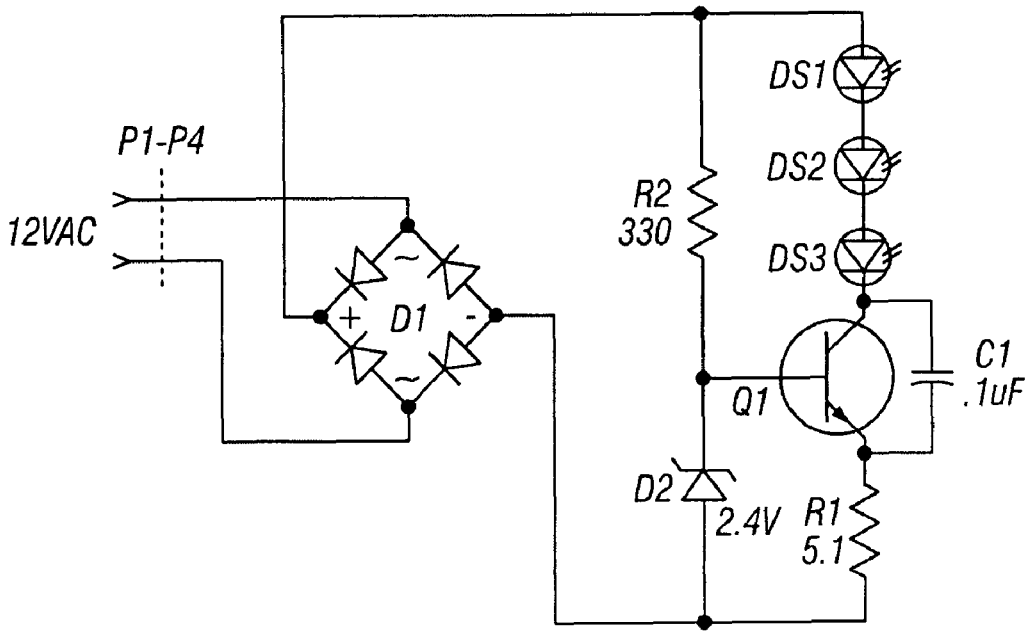
FIG. 7 is an electrical schematic of one embodiment of an LED module assembly of the present invention.

The following Table 1 describes the components shown in FIG. 7, including commercial sources and product numbers for such components.

TABLE 1

| Quantity | Reference Designation on FIG. 7 | Component Description | Package | Vendor | Vendor Part No. |
|---|---|---|---|---|---|
| 1 | D1 | Bridge Rectifier, 400 V, .8A | Mini-Dip SMT | Diodes, Inc. | HD-04 |
| 1 | D2 | Zener Diode 2.4 V, 350 mW | SOT-23 | Diodes, Inc. | BZX84C2V4DICT |
| 1 | Q1 | NPN Power Transistor | D-PACK | Fairchild | FDJ3076 |
| 1 | R1 | 5.1 Ohm 1 W Resistor 1% | 2512 | Generic | — |
| 1 | R2 | 330 Ohm ¼ W Resistor 5% | 1206 | Generic | — |
| 3 | C1 | .1 uF 50 Volt Ceramic Capacitor X7R | 1206 | Generic | — |
| 3 | DS1-DS3 | LED's, Power | 7 mm | Cotco | — |
| 4 | P1-P4 (items 34 on FIG. 2) | Power Connectors Micro Fit 3.0 R/A | SMD | MOLEX | 43650-0212 |
| 1 | (item 18a on FIG. 4) | Custom Printed Circuit Card | N/A | J&J Electrocinc, Inc. | Color Glo ™ Power PCB |

The following Table 2 shows a list of components shown in FIG. 7, including commercial sources for such components.

TABLE 2

Figure 7A:
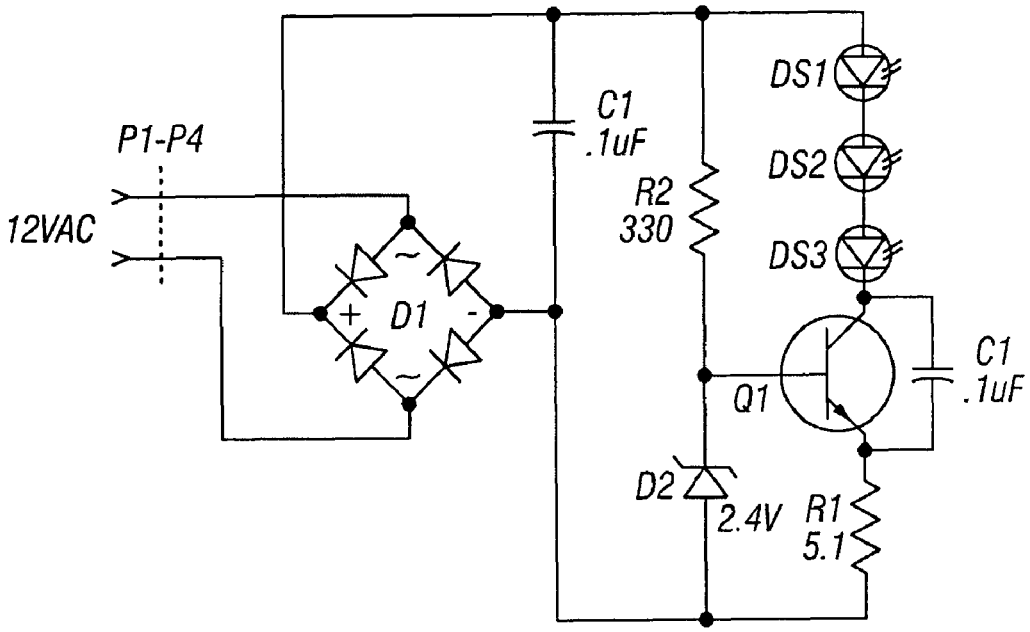
FIG. 7A is an electrical schematic of another embodiment of an LED module assembly of the present invention.

| Quantity | Reference Designation on FIG. 7A | Component Description | Package | Vendor | Vendor Part No. |
|---|---|---|---|---|---|
| 1 | D1 | Bridge Rectifier, 400 V, .8A | Mini-Dip SMT | Diodes, Inc. | HD-04 HD04DITR-ND (3 k reel) |
| 1 | VR1 | Voltage Reference, 2.5 V | SOT-23 | National Semiconductor | LM4040D25IDBZR LM4040D25IDBZR |
| 1 | Q1 | NPN Power Transistor | SOT-223 | On Semi | BCP56T1 |
| 1 | R1 | 10 Ohm ½ W 5% | 2010 | Generic | — |
| 1 | R2 | 1.00K Ohm ¼ W 1% | 1206 | Generic | — |
| 3 | C1, C2 | .1 uF 50 Volt Ceramic Capacitor X7R | 0603 | Generic | — |
| 4 | F1 | Thin Film Fuse 1.25A | 0603 | AVX | F0603E1R25FSTR |
| 3 | DS1-DS3 | LED's, ½ Watt NICHIA, 120 Degree | cool white or green or blue or red or amber | NICHIA | TBD |
| 4 | P1-P4 (also items 34a on FIG. 4) | Power Connectors Micro Fit 3.0 R/A | SMD | MOLEX | 43650-0212 |
| 1 | (item 18a on FIG. 4) | Custom Printed Circuit Card | N/A | J&J Electrocinc, Inc. | Power Plus Channel Letter Module |

Two or more of these LED modules 12*a*, 12*b* may be connected in a series string to provide the desired amount and configuration of illumination, an example of which is seen in FIG. 1. In some embodiments, this series string will operate on AC power to prevent connector corrosion. Also, as shown, the circuitry of these LED modules 12*a*, 12*b* may incorporate a novel pulse regulation circuit, such as those shown in FIGS. 7 and 7A employing an NPN transistor in a common emitter configuration, with a zener clipped base voltage to regulate current pulses in the LEDs in the unfiltered full wave unregulated 60 cycle Hz AC. In at least some embodiments, the LED illumination modules 12*a*, 12*b* can achieve the following objectives:

Use Existing Architecture of low power channel letter system

Avoid use of Aluminum Clad PCB

Run on 12 VAC 75 plus Lumens per Module

Low Cost

Easy Replacement of Module in Field

Light Large Letters

Novel Design, High Reliability, Performance

Modular Interconnect

Integral Heat Sink

One Watt power LED's all require some method of heat transfer to function without over heating. Small package sizes cannot dissipate the heat from the high power dissipated in the devices themselves. A thermal conduction plate is integral to all power LED's and leaves the user the task to provide an external heat sink or other means of removing the heat from the LED. The most common way used today is to use a printed circuit card with an aluminum substrate to do this. However the board is single sided and quite expensive. Also only SMT components can be used which limits the type of on board connectors and things that can be mounted to the board.

The LED's 20 may be mounted on a standard multi-layer FR-4 material printed circuit card. Cooling is achieved in a different way by using a pad on the top surface of the PCB with plated through holes thermally connecting the top layer to the bottom layer of the PCB. The bottom side of the PCB has a large copper pad which transmits heat to the heat sink 18 by use of thermally conductive double sided tape. In at least some embodiments, the plated thru holes may be filled with solder from a wave solder process. The copper pad on the bottom of the circuit board 18 will collect solder in the wave process (know as "ice sickling") due to the large area. To correct this, the solder mask may cover the bottom pad but may be broken with an array of holes in the mask to keep solder build up down, yet provide a good thermal path to the thermally conductive tape.

In applications where a 1 Watt LED module is mounted within an enclosure (e.g., inside of a channel letter), the plastic module used in the 1 Watt LED is product family isolates the bottom of the PCB from the outside air flow such that it is desirable to create a heat sink that can conduct the heat from the bottom thermal pad on the PCB to the outside ambient air was required. The PCB is attached to the thermal tape and secured with two screws and nuts to keep the heat sink and PCB under pressure thru the thermal tape. This assures a good contact to the tape even if the adhesive fails.

The LED module of the present invention may use either 3 AlInGap or 3 InGaN LED's to match voltage drops to the source so that same design can be used for all colors and only use one power supply. This achieves an objective of keeping the product architecture and components to a minimum.

The cables should be revised to use 16 AWG wire instead of 18 AWG to lessen voltage drops caused by the increased current flows. The power modules do provide 4 connection points to allow matrix connections and multiple power feeds if voltage drop becomes an issue. This offers a number of advantages over the series resistor units of the prior art, including:

The ability to drive LED's closer to max spec without current increases;

Cuts down on dissipation when line voltage is high only have (V+)×I;

Power increase is not (V+) (I delta+I). This is about a 20 to 25% reduction depending on Vfd LED and V delta of ac line and IR drop of transformer and wiring;

Novel use of current source on AC power, Regulates on peaks of each cycle to keep power almost constant;

Provides more brightness and more constant heat dissipation over line variations; and Heat is only on Transistor as load changes, easier to heat sink.

In use, the 1 Watt LED lighting modules of the present invention can provide:

High Brightness 75 Lumens per module

LED Design

All Colors Red, Amber, Green, Aqua, Blue, White

Modular, Matrix Connected

Low Cost Dollars per Lumen

12 VAC operation

Lights Large Letters

Replaces Neon or Florescent Tubes and Ballast

Long Life 50K-100K Hours

5 Watt Modules

Architecturally same as Existing Product

Easy Installation and Repair

It is to be appreciated that the invention has been described herein with reference to certain examples or embodiments of the invention but that various additions, deletions, alterations and modifications may be made to those examples and embodiments without departing from the intended spirit and scope of the invention. For example, any element or attribute of one embodiment or example may be incorporated into or used with another embodiment or example, unless to do so would render the embodiment or example unsuitable for its intended use. All reasonable additions, deletions, modifications and alterations are to be considered equivalents of the described examples and embodiments and are to be included within the scope of the following claims.

What is claimed is:

1. An LED module assembly comprising:

a base member selected from the group consisting of; a frame and a housing;

circuit board that comprises a solid state circuit and is mounted on the base member;

one or more LEDs connected to the solid state circuit;

a metal heat sink heat comprising a central portion and a plurality of curved wings, each said curved wing having air-flow slots, wherein at least some of the central portion resides between the base member and the circuit board and wherein the slotted wings extend outboard of the base member and are spaced away from an underlying surface upon which the base member of the LED module assembly is positioned; and a thermal barrier or thermal insulator between at least a portion of the heat sink and at least a portion of the frame or housing;

wherein the solid state circuit includes a power regulator which controls power dissipation over load and line variations.

2. An LED module assembly according to claim 1 wherein the power regulator comprises a zener clamped base drive voltage in a full wave rectified voltage applied to said one or more LEDs to control power dissipation over load and line variations.

3. An LED module assembly according to claim 1 wherein the power regulator comprises a voltage reference and a transistor which operate on full waive rectified alternating current.

4. An LED module assembly according to claim 1 wherein the LEDs comprise 1 Watt or higher Wattage LEDS.

5. An LED module assembly according to claim 1 wherein the carrier frame or housing comprises a polypropylene carrier.

6. An LED module assembly according to claim 5 wherein the heat sink is formed of at lest one metal selected from the group consisting of; aluminum and copper.

7. An LED module assembly according to claim 1 further comprising means for mounting the module on a surface.

8. An LED module assembly according to claim 7 wherein the means for mounting the module on a surface is selected from the group consisting of: adhesive, tape, VHB adhesive tape, apertures through which screws or bolts may be passed, screws, bolts, magnets, clips, clamps and mechanical connectors.

9. An LED module assembly according to claim 1 wherein the circuit board comprises a multi-layer FR-4 material printed circuit board.

10. An LED module assembly according to claim 1 wherein the heat sink includes a pad which through holes thermally connecting the top layer of the printed circuit board to the bottom layer of the printed circuit board.

11. An LED module assembly according to claim 10 further comprising a solder mask having an array of holes to keep solder build up down.

12. An LED module assembly according to claim 1 wherein the thermal barrier or insulator comprises thermal tape.

13. An LED module assembly according to claim 1 further comprising a plurality of connectors useable for connection of that LED module assembly to other LED module assemblies.

14. A system comprising a plurality of LED module assemblies according to claim 1 connected to one another and operable in series.

* * * * *